US006148445A

United States Patent [19]

Spruill

[11] Patent Number: 6,148,445

[45] Date of Patent: Nov. 21, 2000

[54] AWNING SLEEVE SHIRT

[76] Inventor: Gary Rayford Spruill, 1706 E. Cherokee, Enid, Okla. 73701

[21] Appl. No.: 09/360,567

[22] Filed: Jul. 26, 1999

Related U.S. Application Data

[63] Continuation of application No. 60/094,394, Jul. 28, 1998.

[51] Int. Cl.[7] ..... A41B 1/08

[52] U.S. Cl. ..... 2/125; 2/116; 2/269

[58] Field of Search ..... 2/269, 125, 115, 2/116, 126, 106, 108, 59, 114, 129, 131

[56] References Cited

U.S. PATENT DOCUMENTS

| | | | |
|---|---|---|---|
| 209,413 | 10/1878 | Moses | 2/269 |
| 237,096 | 2/1881 | Delmonte | 2/269 |
| 261,318 | 7/1882 | Dobbs | 2/269 |
| 1,157,265 | 10/1915 | Tutelman | 2/269 |
| 2,846,686 | 8/1958 | Tames | 2/125 |
| 3,078,699 | 2/1963 | Huntley | 66/176 |
| 4,068,316 | 1/1978 | Haywood . | |
| 4,473,908 | 10/1984 | Knecht . | |
| 4,475,252 | 10/1984 | Peyser et al. | 2/125 |
| 4,494,246 | 1/1985 | Tillbrook . | |
| 4,768,236 | 9/1988 | Klob . | |
| 4,937,883 | 7/1990 | Shirai | 2/125 |
| 5,029,343 | 7/1991 | McIntyre . | |
| 5,692,239 | 12/1997 | Lewis | 2/125 |

*Primary Examiner*—Amy B. Vanatta

[57] ABSTRACT

An athletic shirt made from a high-performance fabric having a tabbing system which allows the raglan style short sleeves (18) and (18A) to be retracted up to two distinct positions on the shoulders and releasably attached using tabs (14A) and (14B). The athletic shirt provides the athlete wearing the shirt a greater range-of-motion and freedom to compete in his sport without the movement of his arms being inhibited by sleeves which are heavy laden with perspiration.

5 Claims, 9 Drawing Sheets

AWNING SLEEVE SHIRT

CROSS-REFERENCE TO RELATED APPLICATIONS

"This application is entitled to the benefit of Provisional Patent Application Ser.#60/094,394, filed Jul. 28, 1998."

BACKGROUND

1. Field of Invention

This invention generally relates to athletic shirts, and more specifically to an athletic shirt, with the collar, body, and ¾ length raglan style short sleeves with wider sleeves and openings at the hems, made of a high-performance fabric, which increases performance and endurance, and a tabbing system which allows the athlete to wear the shirt with the sleeves down or allows the athlete the capability to retract one or both short sleeves up into two distinct positions providing for a greater range of motion and freedom to perform and compete in their sport.

2. Description of Prior Art

Originally, athletes, especially those who play tennis and golf, have had a limited choice of athletic shirts to wear. Often, they have had to choose from sportswear that has been designed more for the general public to wear than for them to wear for their particular sport. In other words, sportswear designers have designed their garments for mass consumption instead of creating shirts for athletes to wear that addressed the specific needs of those competing in a particular sport. Therefore, the result has been that athletes have had to wear ill-fitting moisture absorbing shirts that have been a great hindrance to their comfort and range-of-motion while they have competed.

Tennis players, especially professionals who competed in tournaments, have had to wear shirts that became so heavy-laden with sweat clinging to their bodies that their ability to compete, without being distracted by their shirts, was greatly reduced. Anyone, who has watched professional tennis players in a tournament has noticed how the tennis players are constantly struggling with their sleeves. Most of these players tried to drape the sleeves up over their shoulders to get them out of their way and increase their range-of-motion. Or, they constantly tugged at the shoulder seams, of a sweat-laden shirt, in an attempt to get them up over the shoulders so they can serve the ball without feeling the shirt binding them. And, when receiving serve they have constantly tried to raise both sleeves over their shoulders to regain a range-of-motion that was lost once the shirt became soaked with sweat.

The only alternate tennis players have had is to change shirts when the opportunity presented itself, and due to the fabric used in most of these shirts they became quickly soaked, once again, with perspiration. And, these shirts which had a slow drying-rate, within a few minutes, were no better than the ones they had just taken off.

Golfers have experienced the same problems as tennis players, especially when drying the ball, their shirts became heavily soaked with perspiration and clinged to their arms and shoulders as they swung their club. Golfers constantly have pulled and tugged at their sleeves to regain a range-of-motion that was lost due to an ill-fitting and poorly designed shirt.

Other athletes such as softball players, volleyball players, weight-lifters, have needed a shirt capable of retracting the sleeves up at crucial moments of competition. And, they have had the same experiences of a shirt that became so sweat drenched that it hampered their range-of-motion.

Many tennis and golf facilities require members and guests to wear a collared shirt as a part of their dress-code. Therefore, tank-tops and muscle shirts offered no solution to the problems faced by these athletes.

The invention and patenting of high-performance fabrics, such as Dri-Release.™. by Optimer and CoolMax.™. by DuPont, which move the moisture away from the skin have only partially solved these problems. Regardless, of the faster drying-rate properties, which is approximately twenty to thirty minutes, and better breathability of these fabrics athletes still had to wear sweat-laden shirts which limited their range-of-motion and freedom to compete at crucial moments. Sportswear designers have failed to recognize that high-performance fabrics alone cannot solve some of the problems these athletes have encountered with their shirts. Sportswear designers simply used these high-performance fabrics to manufacture the same styles of shirts that have been marketed in the past. In most cases, the athlete was through, the match was over, before the shirt, especially the sleeves, had dried. Therefore, athletes have needed a shirt that would provide the effects of high-performance fabrics while at the same time being functional in that they could retract the sleeves and move them up and out of their way.

SUMMARY

The present invention pertains to an athletic shirt, and more specifically to an athletic shirt comprising a high-performance fabric, ¾ length raglan style short sleeves with wider sleeves and openings at the hems, and a tabbing system which allows the athlete wearing the shirt to wear the sleeves down or retract one or both of them up into two distinct positions.

Objects and Advantages

Accordingly, the objects and advantages of the present invention are:

(a) to provide an athletic shirt, made of a high-performance fabric, which works in combination with the shirt's functioning design, and this combination is achieved when the athlete decides, due to the rate of perspiration of the athlete being greater than the rate of evaporation of the fabric, to retract one or both sleeves to increase comfort and range-of-motion;

(b) to provide an athletic shirt which increases endurance due to the high-performance fabric and the shirt's functioning retractable sleeves the athlete is expending less energy by not having to constantly tug or try to drape the sleeves up over the shoulders to regain freedom and range-of-motion;

(c) to provide an athletic shirt which has wider ¾ length raglan style short sleeves and larger armhole openings at the hems, and this is accomplished by larger front and back armhole lengths, to which the sleeves are sewn, than what is found in typical sportswear with raglan style short sleeves;

(d) to provide an athletic shirt which has a tabbing system that allows the athlete to retract one or both sleeves up into two distinct positions and securely lock the sleeve (s) into place. And, the tabbing system also allows for a fast-release of the sleeve(s) if the athlete decides to put the sleeve(s) down in the normal position;

(e) to provide an athletic shirt, made of a high-performance fabric, which has retractable sleeves and a collar. The collar, which is also part of the tabbing system, allows the shirt to conform with dress-code requirements of many private tennis and golf facilities;

(f) to provide an athletic shirt which allows the ¾ length raglan style short sleeves to be easily, in less than approximately one minute of time, be retracted up giving the athlete wearing the shirt the choice of two distinct positions. These positions are: (1.) the sleeve(s) can be retracted up to the scapula of the shoulder, (2.) the sleeve(s) can be retracted up, in the extreme position, to the clavicle of the shoulder;

(g) to provide an athletic shirt which allows the athlete wearing the shirt a greater range-of-motion and freedom, especially when serving and receiving serve, while playing tennis than can be provided by wearing ordinary tennis shirts which have no operating sleeves;

(h) to provide an athletic shirt which has retractable sleeves and does not have shoulder seams which cut into and bind the shoulders of the athletes wearing the shirt. This is accomplished by the ¾ length raglan style short sleeves; and (i) to provide an athletic shirt which has wider or roomier sleeve(s) so that when the sleeve(s) are retracted the fabric which is gathered under the arm(s) will not bind the wearer of the shirt. Various other objects and advantages of the present invention become apparent to those skilled in the art from a consideration of the ensuing description and drawings.

DRAWING FIGURES

REFERENCE NUMERALS IN DRAWINGS

Figure 1:
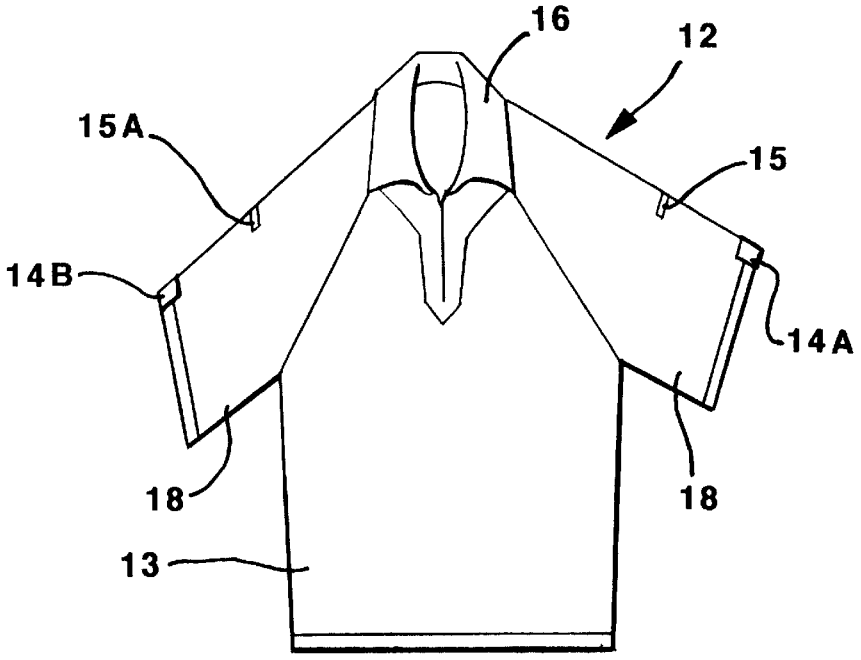
FIG. 1 shows a front view of the present invention.

12 is an arrow pointing to a front view of athletic shirt
12A is an arrow pointing to a back view of athletic shirt
13 front panel body portion of the athletic shirt
13A back panel body portion of the athletic shirt
14 folded fabric to which the hook-and-loop fasteners are sewn
14A tab on left sleeve
14B tab on right sleeve
14C female (loop) portion of the hook-and-loop fasteners sewn in tab on left sleeve
14D male (hook) portion of the hook-and-loop fasteners sewn in tab on left sleeve
14E female (loop) portion of the hook-and-loop fasteners sewn in tab on right sleeve
14F male (hook) portion of the hook-and-loop fasteners sewn in tab on right sleeve
15 label on left sleeve
15A label on right sleeve
16 collar
16A strip of female (loop) portion of the hook-and-loop fasteners sewn to the underside of collar on the left side
16B strip of female (loop) portion of the hook-and-loop fasteners sewn to the underside of collar on the right side
18 left sleeve
18A right sleeve
20 braided twill tape loop sewn to inside of the left sleeve
20A braided twill tape loop sewn to inside of the right sleeve
22 front armhole length
24 back armhole length

DETAILED DESCRIPTION

Figure 2:
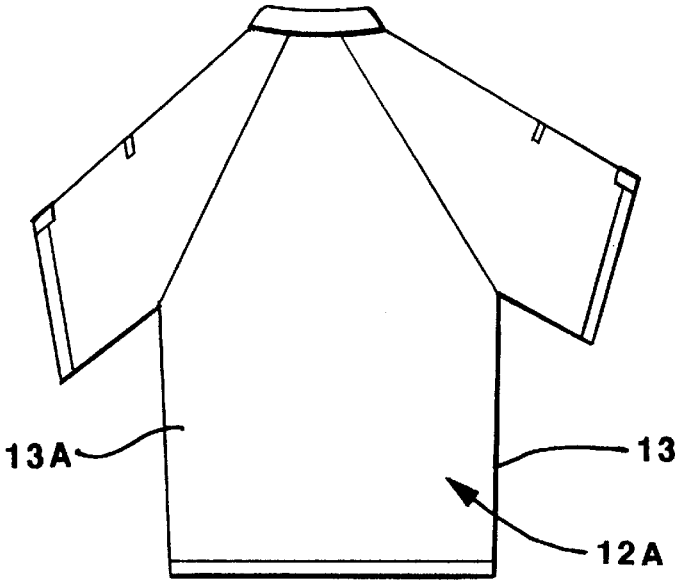
FIG. 2 shows a back view of the present invention.

FIGS. 1 and 2—Preferred Embodiment

A preferred embodiment of the present invention is illustrated in FIG. 1 (front view) and FIG. 2 (back view). FIG. 1 depicts a front view of an athletic shirt as indicated by arrow 12 having a front panel body portion 13, sleeves 18 and 18A, and a sewn in collar 16. Sleeves 18 and 18A are identical, with the exception sleeve 18 is a left sleeve and sleeve 18A is a fight sleeve, ¾ length raglan style short sleeves. Also, depicted in FIG. 1 are tab 14A on left sleeve and tab 14B on right sleeve and label 15 on left sleeve and label 15A on right sleeve. Tabs 14A and 14B are, permanently affixed, sewn to outside of sleeves 18 and 18A at the hems of the armhole openings directly opposite of sleeve seams. Tabs 14A and 14B comprise an assembly of folded fabric to which hook-and-loop fasteners are sewn to. Tabs 14A and 14B can open and close. In the closed position the hook-and-loop fasteners of tabs 14A and 14B are not visible. Tabs 14A and 14B do not overlap sleeves 18 and 18A and hangover the bottoms of the hems but are sewn even with the bottom of the hems of sleeves 18 and 18A.

FIG. 2 depicts a back view of an athletic shirt as indicated by arrow 12A having a back panel body portion 13A.

Front panel 13, Back panel 13A, sleeves 18 and 18A, and collar 16, are made out of a high-performance fabric (such as trademarked "CoolMax Alta" by DuPont) or (such as trademarked "Coolmax" by DuPont).

Collar 16 is shown in this illustration as folded down in the normal position. Tabs 14A and 14B are shown in this illustration in the closed position.

Figure 3:
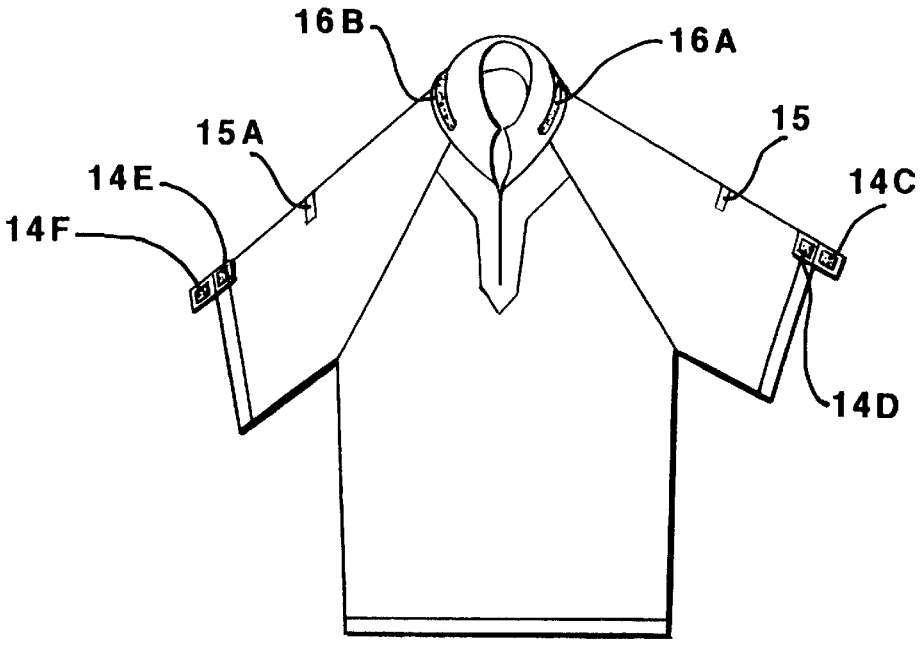
FIG. 3 shows a front view of the present invention with the collar raised and the sleeve tabs opened.

FIG. 3—Additional Embodiment

FIG. 3 depicts athletic shirt of FIGS. 1 and 2 with collar 16 raised and tabs 14A and 14B in the opened position. Tabs 14A and 14B comprise an assembly of hook-and-loop fasteners. Female (loop) portion 14C of the hook-and-loop fasteners is sewn in tab 14A. Male (hook) portion 14D of the hook-and-loop fasteners is sewn in tab 14A. Female (loop) portion 14E of the hook-and-loop fasteners is sewn in tab 14B. Male (hook) portion 14F of the hook-and-loop fasteners is sewn in tab 14B. A strip of female (loop) portion 16A of the hook-and-loop fasteners is sewn on the left side to the underside of collar 16. A strip of female (loop) portion 16B is sewn on the right sided to the underside of collar 16. Labels 15 and 15A are sewn to the outside of sleeves 18 and 18A.

Labels 15 and 15A are sewn ½ an inch down from the midway measurement point of sleeves 18 and 18A. A men's large shirt has a sleeve length, from the neck seam to the end of the hem at the sleeve opening, of approximately seventeen inches. Thus, labels 15 and 15A are, permanently affixed, sewn approximately nine inches down from the neck seam on sleeves 18 and 18A. Labels 15 and 15A are approximately ½ inches wide and 2.5 inches in length. Labels 15 and 15A are sewn horizontal to sleeve hems.

Strips of female (loop) portions 16A and 16B are approximately ½ inch wide and four inches in length. Strips 16A and 16B are, permanently affixed, sewn to collar 16 ⅜ inches above the neck seam where collar 16 is sewn to shirt. Strips 16A and 16B are sewn horizontal to the neck seam, and placement of strips 16A and 16B on collar 16 is between where front panel 13 and back panel 13A is sewn to sleeves 18 and 18A at the neck opening.

FIG. 4

Figure 4:
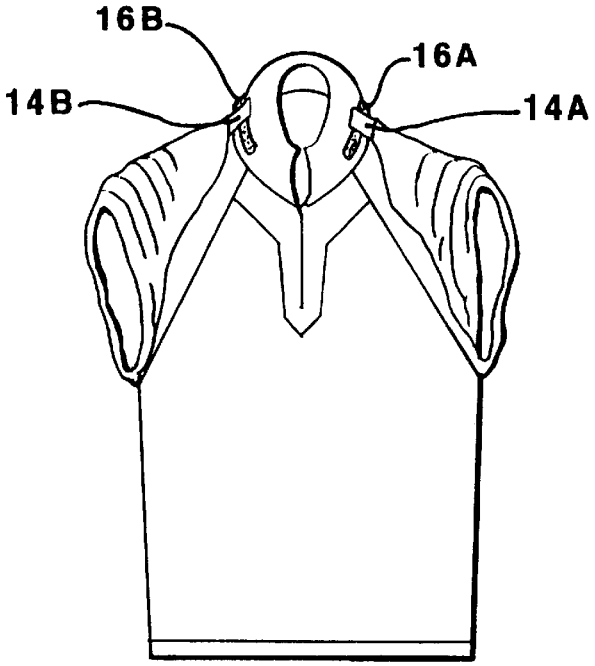
FIG. 4 shows a front view of the present invention with the sleeves being retracted to the scapula position on the shoulder(s) and the hook-and-loop fasteners being mated to the collar.

FIG. 4 depicts sleeves 18 and 18A retracted to the scapula position on the shoulders. Male (hook) portions 14D and 14F of tabs 14A and 14B are mated to strips 16A and 16B of collar 16. Sleeves 18 and 18A are held securely in place and are releasably attached.

FIG. 5

Figure 5:
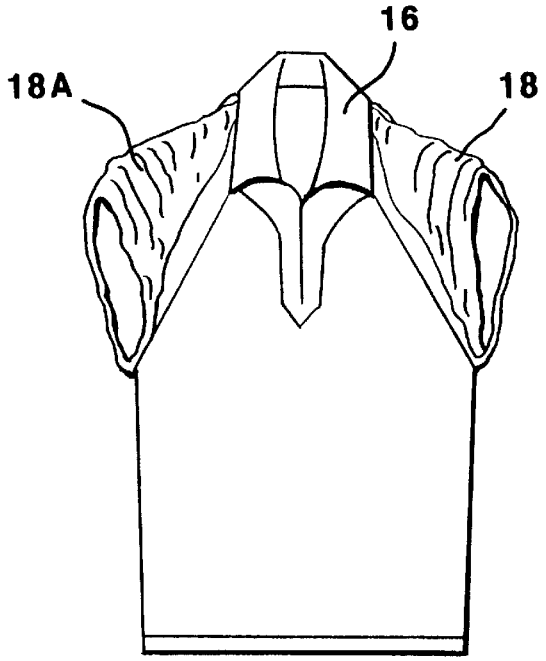
FIG. 5 shows a front view of the present invention with the sleeves being retracted to the scapula position on the shoulder(s) and the collar folded down in its normal position.
Figure 6:
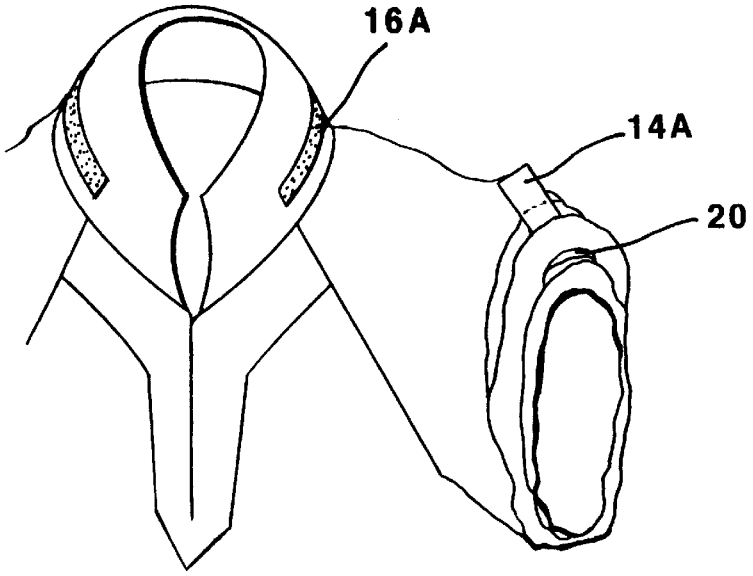
FIG. 6 shows the tab(s) on the sleeve(s) in the open position and shows the braided twill tape loop(s) that is sewn to the inside of the sleeves. The tab(s) is pulled through the loop(s), which gathers the excess fabric, and the sleeve(s) is retracted up into the clavicle position on the shoulder(s).
Figure 6A:
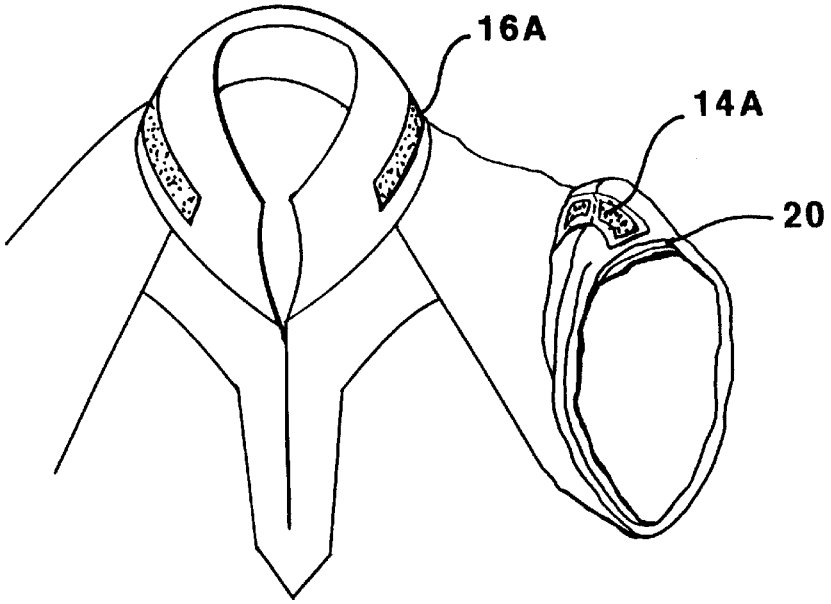
FIG. 6A shows that the hook-and-loop fasteners of the tab(s) is pulled through the braided twill tape loop(s) which is sewn to the inside of the sleeves.
Figure 6B:
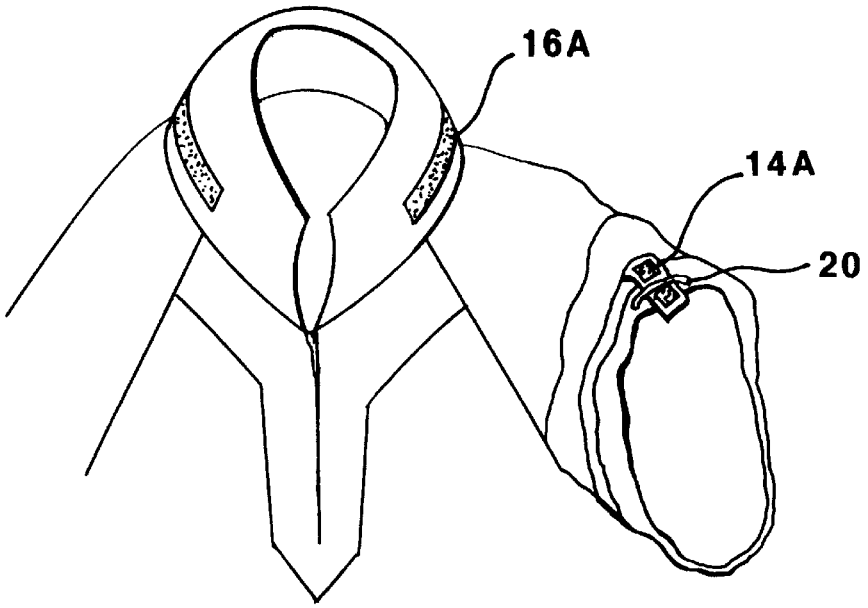
FIG. 6B shows the tab(s) being inserted through the braided twill tape loop(s) which is sewn to the inside of the sleeve(s).
Figure 6C:
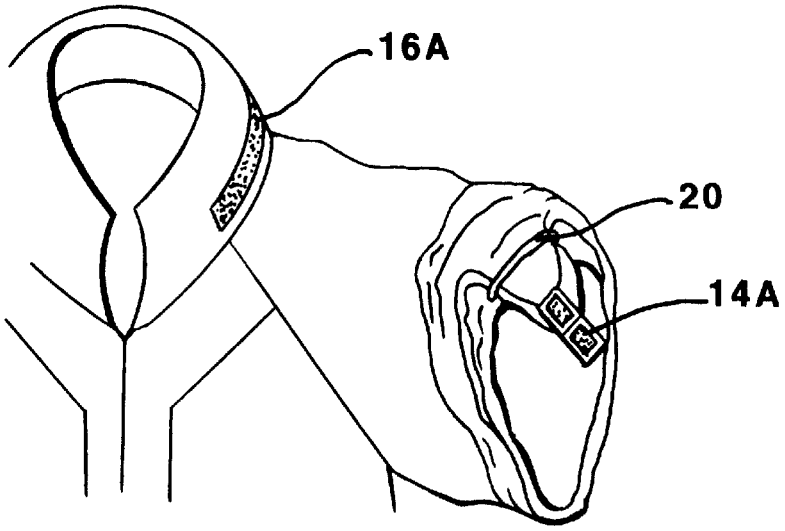
FIG. 6C shows the tab(s) and a portion of the fabric, where the tab(s) are sewn to the sleeve(s), being pulled through the braided twill tape loop(s).
Figure 6D:
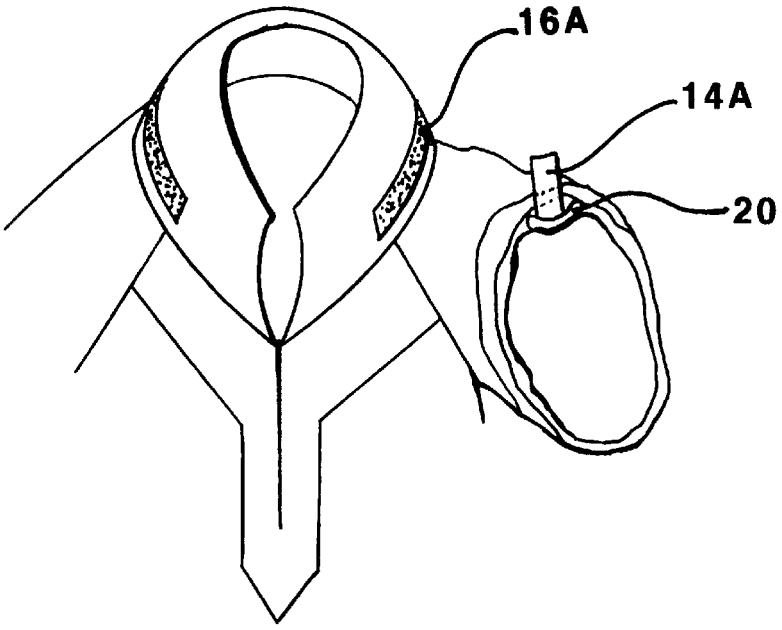
FIG. 6D shows tat once the tab(s) is inserted and pulled through the braided twill tape loop(s) the sleeve(s) are retracted up and the hook-and-loop fasteners are then mated to the collar.

FIG. 5 depicts athletic shirt of FIG. 4 with sleeves 18 and 18A retracted to the scapula position on the shoulders, and collar 16 being folded back down to the normal position once sleeves 18 and 18A are releasably attached.

FIGS. 6, 6A, 6B, 6C, and 6D

FIGS. 6, 6A, 6B, 6C, and 6D depicts tab 14A in the open position being inserted and pulled through braided twill tape loop 20 which is sewn, at each end, to the inside of the left sleeve just behind label 15. The functions of labels 15 and 15A is to hide the stitches where the ends of braided twill tape loops 20 and 20A are sewn to sleeves 18 and 18A. And, braided twill tape loops 20 and 20A are approximately 2.5 inches in length. Twill tape loops 20 and 20A are sewn, permanently affixed, to sleeves 18 and 18A at the ends of each loop. The braided twill tape loop 20A of the right sleeve 18A is identical to loop 20 of sleeve 18 and is sewn exactly in the same manner and location on sleeve 18A as is on sleeve 18. And, tab 14B is inserted and pulled through braided twill tape loop 20A in the same manner.

Once, the tab 14A is inserted and pulled through braided twill tape loop 20 sleeve 18 is retracted to the clavicle position on the shoulder. And, tab 14A is mated to strip 16A on collar 16. Sleeve 18A is retracted to the clavicle position in the same manner using tab 14B and braided twill tape loop 20A.

Figure 7:
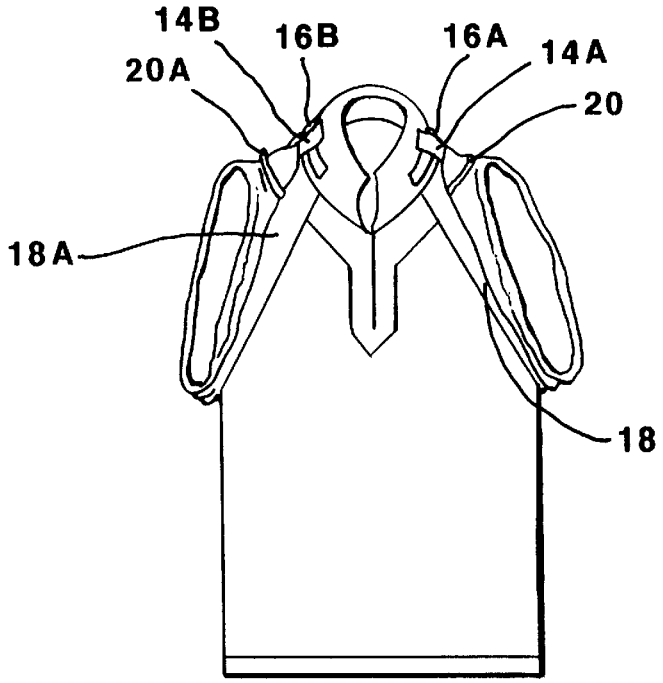
FIG. 7 shows the sleeve(s) being retracted, in the extreme position, to the clavicle position on the shoulder(s) and being mated to the collar.
Figure 7A:
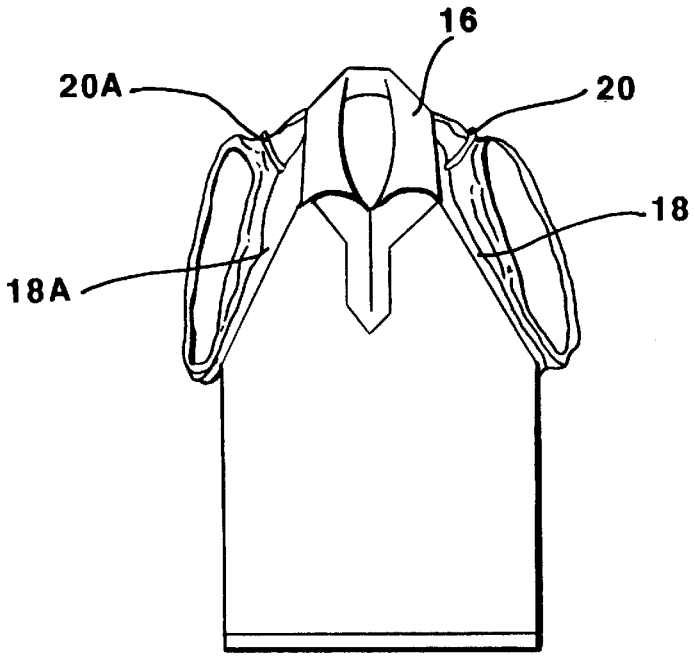
FIG. 7A shows the sleeve(s) being retracted to the clavicle position on the shoulder(s) and the collar being folded down in the normal position.

FIGS. 7 and 7A

FIG. 7 depicts sleeves 18 and 18A retracted to the clavicle position on the shoulders. Tabs 14A and 14B are inserted and pulled through braided twill tape loops 20 and 20A and mated to strips 16A and 16B on collar 16.

FIG. 7A depicts athletic shirt of FIG. 7 with collar 16 folded back down, in the normal position, once the sleeves 18 and 18A are releasably attached.

Figure 8:
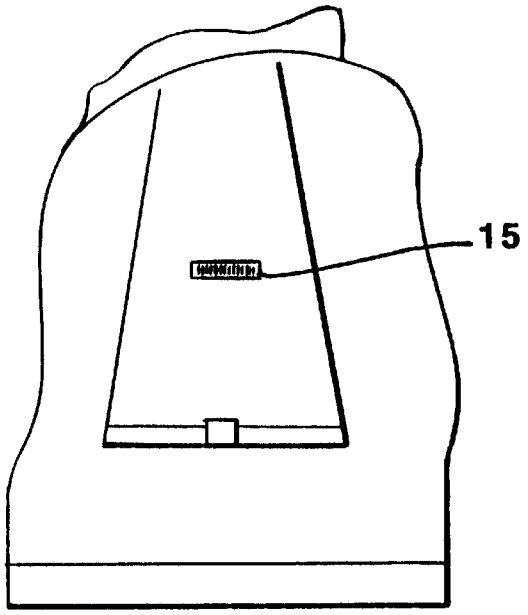
FIG. 8 shows the label(s) sewn to the outside of the sleeve(s).
Figure 8A:
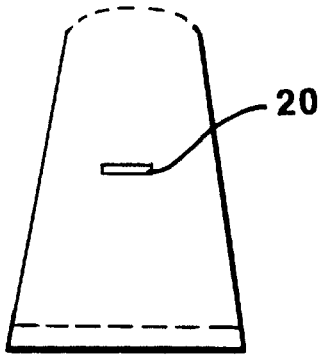
FIG. 8A shows the braided twill tape loop(s) that is sewn to the inside of the sleeve(s).

FIGS. 8 and 8A

FIG. 8 depicts where labels 15 and 15A are sewn to sleeves 18 and 18A. Labels 15 and 15A are sewn, to the outside of sleeves 18 and 18A, on all four sides to sleeves 18 and 18A. Labels 15 and 15A are placed on the fabric and sewn horizontally at ½ inch down from the midpoint measurement of sleeve's 18 and 18A length.

FIG. 8A depicts where braided twill tape loop(s) 20 and 20A are sewn to the inside of sleeves 18 and 18A. Twill tape loop(s) 20 and 20A are sewn inside sleeves 18 and 18A at the same measurement as labels 15 and 15A. A color different than that of sleeves 18 and 18A is used for twill tape loop(s) 20 and 20A so to be easily visible when the athlete decides to insert and pull tabs through to retract sleeves to the clavicle position.

FIG. 9

Figure 9:
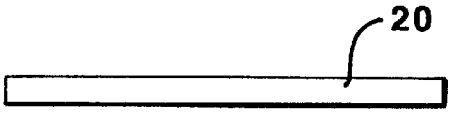
FIG. 9 shows the braided twill tape loop(s).

FIG. 9 depicts braided twill tape loop(s) 20 and 20A.

FIG. 9A

Figure 9A:
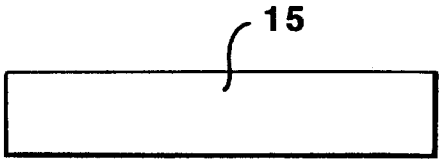
FIG. 9A shows the label(s).

FIG. 9A depicts label(s) 15 and 15A. Labels can be woven or printed made from various fabrics such as cotton, polyester, or a blend of cotton and polyester.

FIGS. 10, 10A, 10B, 10C, and 10D

Figure 10:
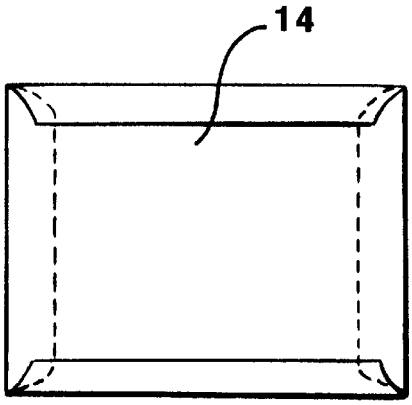
FIG. 10 shows the folded fabric to which the hook-and-loop fasteners are sewn.

FIGS. 10, 10A, 10B, 10C, 10D, and including FIG. 9 comprises the tabbing system of the present invention. FIG. 10 depicts a folded piece of fabric 14. Fabric 14 can be the same high-performance fabric which front panel 13, back panel 13A, sleeves 18 and 18A, and collar 16 are made from. Fabric 14 measures, when folded, approximately two inches wide and 1⅝ inches in length.

Figure 10A:
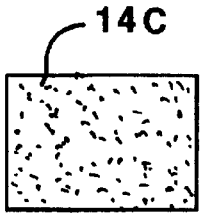
FIG. 10A shows the male (hook) portion of the hook-and-loop fasteners.
Figure 10B:
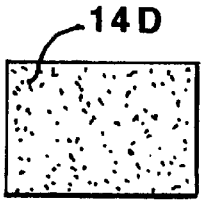
FIG. 10B shows the female (loop) portion of the hook-and-loop fasteners.
Figure 10D:
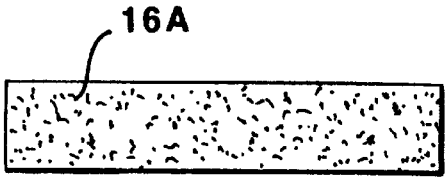
FIG. 10D shows a strip(s) of the female (loop) portion of the hook-and-loop fasteners which are sewn to the underside of the collar.
Figure 10C:
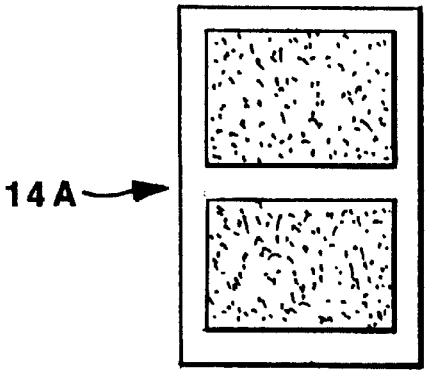
FIG. 10C shows the tab(s) which are constructed out of the folded fabric and the hook-and-loop fasteners.

FIG. 10A depicts a female (loop) portion 14C of hook-and-loop fasteners which is sewn to ½ of fabric 14. FIG. 10B depicts a male (hook) portion 14D of hook-and-loop fasteners which is sewn to the other ½ of fabric 14. FIG. 10C depicts the assembly of fabric 14, male (hook) portion 14D, and female (loop) portion 14C, which comprises tab 14A. It should be noted that it is female (loop) portion 14C half of tab 14A which is sewn to sleeve hem and male (hook) portion 14D half of tab 14A is what opens and closes tab. Tab 14B is constructed in the same manner as 14A.

Figure 11:
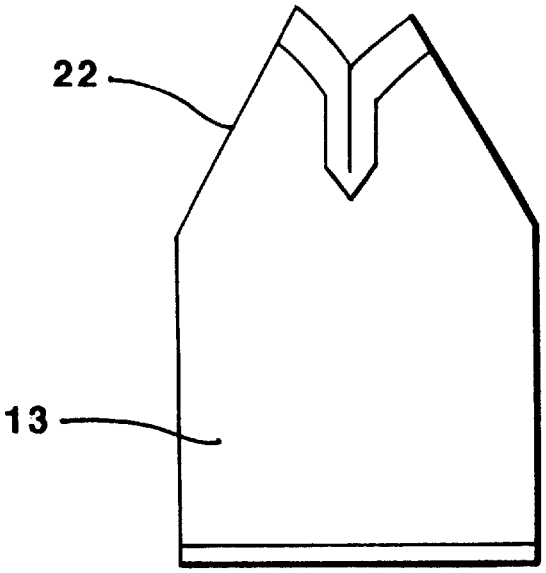
FIG. 11 shows a front armhole length, which is longer than what is found in most raglan style short sleeve shirts, to which the sleeve(s) are sewn.
Figure 11A:
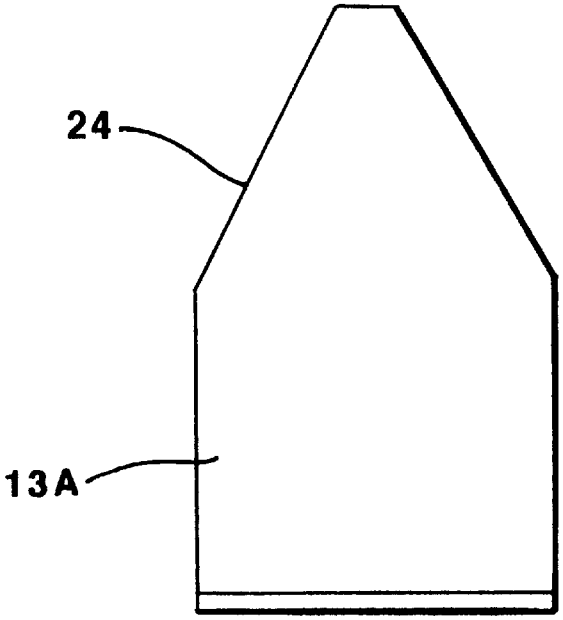
FIG. 11A shows a back armhole length, which is longer than what is found in most raglan style short sleeve shirts, to which the sleeve(s) are sewn.

FIGS. 11 and 11A

FIG. 11 depicts front armhole length 22 in front panel 13. Armhole length 22 in a men's size large is approximately 14.5 inches in length. A longer front armhole length 22 provides for larger and wider sleeve(s) 18 and 18A.

FIG. 11A depicts back armhole length 24 in back panel 13A. Back armhole length 24 in a men's size large is approximately 16 inches in length. A longer back armhole length 24 provides for larger and wider sleeve(s) 18 and 18A.

Longer armhole lengths 22 and 24 provide larger and wider sleeve(s) 18 and 18A. And wider and larger sleeve(s) 18 and 18A means that the openings at the hems of sleeves 18 and 18A are larger which allows for easy retraction of sleeves 18 and 18A. In a men's size large the opens at the hems of sleeve(s) 18 and 18A are approximately 11 inches. And, the openings at the hems are approximately 22 inches in circumference.

The illustrations and examples provided herein are for explanatory purposes, such as arrow 12 is pointing to a front view of a zippered placket shirt, but other types of shirts with collars, such as three or four button placket shirts or V-neck shirts with collars, could be used. What is necessary is a collar, raglan style short sleeves, longer front and back armhole lengths which provide for larger and wider sleeves, and a tabbing system to retract sleeves. And, other means to releasably attach retractable sleeve(s) 18 and 18A, instead of hook-and-loop fasteners, such as snaps, buttons, zippers, adhesives, or the like may also be used as desired under certain circumstances. And, the size of tabs 14A and 14B can be larger or smaller to accommodate the means used to releasably attach retractable sleeve(s) 18 and 18A. And, the illustrations and examples are not intended to limit the scope of the appended claims.

Advantages

From the description above, a number of advantages of the present invention, the awning sleeve shirt, become evident:

(a) The high-performance fabric works in combination with the tabbing system to provide the athlete with a shirt which offers all the benefits of a fabric that can wick the perspiration away from the body and retract the sleeves to regain freedom and range-of-motion when the wicking properties of the fabric can not keep up with the rate of perspiration of the athlete.

(b) Endurance and performance is increased because of the properties of the high-performance and because, the athlete can retract the sleeves when they become heavy-laden with sweat, the athlete is not experiencing the normal resistance of the fabric against the arms which can increase fatigue.

(c) Fatigue is reduced because the athlete can retract the sleeves and is not constantly pulling and nagging at the sleeves trying to drape them up over the shoulders. A constant pulling and tugging at the sleeves, which the athlete experiences not wearing the awning sleeve shirt, has a cumulative effect in leading to arm fatigue.

(d) Mental stress is reduced wearing this shirt because the athlete is not being hampered by his range-of-motion being limited or by sleeves clinging to his arms causing him to worry more about his clothing than his competition.

(e) The large front and back armhole lengths provide for larger, wider, and roomier sleeves which allows the athlete more freedom of arm movement within the sleeves when they are not retracted.

(f) The larger and wider sleeves allow for larger armhole openings at the hems of the sleeves which permits a less binding sleeve and for a sleeve which is easily retractable and not binding to the underarm when retracted.

(g) The tabbing system allows the athlete two distinct choices of retraction for the sleeves: 1.) retract the sleeves to the scapula of the shoulders, or 2.) retract the sleeves to the clavicle of the shoulders.

(h) The ¾ length raglan style short sleeves which are retractable allows the athlete a shirt with no shoulder seams to cut into, bind, or rub his shoulders.

(i) The hook-and-loop fasteners of the tabbing system allows the athlete the ability to quickly retract the sleeves and attach them in place. And, allows for a fast-release of the sleeves if the athlete decides to put the sleeves back down.

(j) The athlete can retract one or both sleeves depending on the range-of-motion needed.

Operation

FIGS. 1–11A

The manner of using the present invention is as follows: The athlete wears the awning sleeve shirt as one would wear any normal athletic shirt. The athlete can wear sleeves 18 and 18A down, not retracted, in the normal position. When, the athlete decides that he needs a greater range-of-motion, and this may be because the sleeves are becoming soaked with perspiration or just because he decides he wants one or both sleeves 18 and 18A retracted for greater freedom, he has two choices for retracting sleeves 18 and 18A.

If the athlete decides to retract one or both sleeves 18 and/or 18A to the scapula position on the shoulder(s), he simply opens tab(s) 14A and/or 14B and raises collar 16 and mates male (hook) portion(s) 14D and/or 14F to strips of female (loop) portion(s) 16A and/or 16B of collar 16. Once, the sleeves 18 and/or 18A is securely mated the athlete folds collar 16 back down to its normal position.

If the athlete decides he wants the sleeves 18 and/or 18A back down to the normal position, he can simply reach under the collar 16 and releasably detach 14D and/or 14F from 16A and/or 16B from collar 16. The athlete then can close tab(s) 14A and/or 14B by mating 14D and/or 14F with female (loop) portions 14C and/or 14E of tabs 14A and/or 14B.

If the athlete decides to retract one or both sleeves 18 and/or 18A to the clavicle position on the shoulder(s), he simply opens tab(s) 14A and/or 14B and raises collar 16. He then retracts sleeve(s) 18 and/or 18A to a position where braided twill tape loop(s) 20 and/or 20A, which are sewn to the inside(s) of sleeve(s) 18 and/or 18A, are exposed. He then inserts and pulls tab(s) 14A and/or 14B through twill tape loop(s) 20 and/or 20A and retracts the sleeve(s) 18 and/or 18A on up to the clavicle position on the shoulder(s) and mates 14D and/or 14F of tab(s) 14A and/or 14B to strip(s) 16A and/or 16B of collar 16. Once, 14D and/or 14F are securely mated the athlete can fold collar 16 back down to it normal position.

If the athlete decides he wants the sleeve(s) 18 and/or 18A back down to a normal position, he can simply reach under collar 16 and releasably detach 14D and/or 14F from strip(s) 16A and/or 16B of collar 16. And, then pull the sleeve(s) 18 and/or 18A back down to the point of the twill tape loop(s) 20 and/or 20A and pull tab(s) 14A and/or 14B out of the twill tape loop(s) 20 and/or 20A. The athlete then can close tab(s) 14A and/or 14B by mating 14D and/or 14F with 14C and/or 14E.

Conclusion, Ramifications, and Scope

Accordingly, the reader will see that the awning sleeve shirt, the present invention herein, permits the athlete wearing the shirt the choice of retracting the ¾ length raglan style short sleeves, by use of the tabbing system, to regain a range-of-motion that is lost when the shirt becomes heavy-laden with sweat. Furthermore, the awning sleeve shirt has the additional advantages in that

- it permits the athlete wearing the shirt to retract one or both sleeves to the shoulder(s), by use of the tabbing system, depending upon his needs and circumstances;
- it permits the athlete wearing the shirt two choices, by use of the tabbing system, of where on the shoulder(s) he can retract the sleeve(s): 1.) the sleeve(s) can be retracted to the scapula position on the shoulder(s), or 2.) the sleeve(s) can be retracted to the clavicle position on the shoulder(s);
- it permits the athlete to wear a shirt made of a high-performance fabric that works in combination with the functioning, retractable, sleeve(s) in that when the benefits of the fabric can not keep up with the rate of perspiration of the athlete he can retract the sleeve(s) and regain his range-of-motion and freedom to compete;
- it permits the athlete to wear a shirt that will increase his endurance and reduce his fatigue in that he can retract the sleeve(s) and will not be expending his energy in constantly tugging or pulling at the sleeves trying to drape them up over his shoulder(s);
- it permits the athlete to wear a shirt that will increase his endurance and performance in that when the sleeve(s) are retracted the athlete is not experiencing the resistance of the fabric against his arm(s) which leads to fatigue;
- it permits the athlete to wear a shirt, due to its large front and back armhole lengths, a larger, wider, and roomier short sleeve(s) which allows more freedom of movement when the sleeve(s) are not retracted;
- it permits the athlete to wear a shirt, due to its large front and back armhole lengths, with wider sleeve openings at the hems which means the sleeve(s) when retracted will not bind the underarm(s) and more freedom of movement when the sleeve(s) are not retracted;
- it permits the athlete to wear a shirt, due to its raglan style short sleeves, without shoulder seams to cut, bind, or rub his shoulders and still have the option of retracting one or both sleeves;
- it permits the athlete to wear a shirt made of a high-performance fabric, retractable ¾ length raglan style short sleeves, and a collar which allows the shirt to conform to the dress-code requirements of many private tennis and golf facilities;
- it permits the athlete to wear a shirt by use of its tabbing system, whereby the sleeve(s) can be retracted quickly and it allows for the sleeve(s) to be releasably attached so that if the athlete decides to put the sleeve(s) back down he can do so by fast-release quickly;
- it permits the athlete to wear a shirt which can be worn for several types of sports, where the athlete might desire to have retractable sleeves, such as tennis, golf, volleyball, softball, weightlifting and others.

Although, the descriptions above contains many specificities, these should not be construed as limiting the scope of the invention, but merely providing illustrations.

Thus, the scope of the invention should be determined by the appended claims and their legal equivalents, rather than by the examples given.

I claim:

1. An athletic shirt comprising:

(a) a body portion having a front panel and a back panel made out of a moisture-wicking, fast-drying, high-performance fabric;

(b) raglan style short sleeves made out of said high-performance fabric permanently sewn to said body portion, and said sleeves may be retracted to two distinct positions up and on the shoulders of the wearer defining a first distinct position and a second distinct position; and (c) a tabbing system means for retracting and releasably attaching each sleeve to a collar, and said tabbing system securely attached to each side of said shirt, and said tabbing system comprises an assembly of:

a collar made out of said high-performance fabric sewn to said body portion at a neck opening;

releasable first fastening means securely attached to the underside of said collar at a position proximal a seam adjoining said collar to said body portion of said shirt;

releasable second fastening means which cooperates with said first releasable fastening means, said releasable second fastening means securely attached to the outer side of said sleeve adjacent an opening end of said sleeve, and said releasable second fastening means aligned with said releasable first fastening means, and said second releasable fastening means engages said first releasable fastening means when said sleeve is retracted to said first distinct position; and a twill tape loop attached to the inner surface of said sleeve, and when said sleeve is retracted to said second distinct position said second fastening means can be passed through said twill tape loop gathering excess sleeve fabric and then said second fastening means is engaged with said first fastening means.

2. The athletic shirt as in claim 1, wherein said first and second releasable fastening means comprise cooperative button and button hole, cooperative snap-elements, or cooperative hook and loop fasteners.

3. The athletic shirt as in claim 1, wherein said two distinct positions are first a scapula position and second a clavicle position.

4. The athletic shirt as in claim 2, wherein said sleeves may be retracted to said scapula position and said clavicle position.

5. An athletic shirt comprising:

(a) a body portion having a front panel and a back panel made out of a moisture-wicking, fast drying, high-performance fabric;

(b) raglan style short sleeves made out of said high-performance fabric permanently sewn to said body portion, and said sleeves may be retracted to two distinct positions up and on the shoulders of the wearer defining a scapula position and a clavicle position; and (c) a tabbing stem means for retracting and releasably attaching each sleeve to a collar, and said tabbing system securely attached to each side of said shirt, and said tabbing system comprises an assembly of:

a collar made out of said high-performance fabric sewn to said body portion at a neck opening;

a strip of female loops of hook and loop fasteners, of predetermined size, sewn to the underside of said collar at a position horizontal and proximal to said seam adjoining said collar to said neck opening;

a tab, of predetermined size, which may be opened and closed, wherein said tab comprises an assembly of:

a piece of fabric, of predetermined size, having an upperside and a lower side, to which a portion of female loops of hook and loop fasteners is sewn to a first half of said upper side of said fabric, and a portion of male hooks of hook and loop fasteners is sewn to a second half of said upper side of said fabric, and said male hooks sewn to said upper side of said second half of said fabric can be releasably engaged with said female loops sewn to said upper side of said first half of said fabric, and when said male hooks are releasably engaged with said female loops a bight is formed in the middle of said fabric, and when said male hooks are releasably engaged with said female loops said tab is in a closed position, and said lower side of said first half of said fabric is sewn to the outer side of said sleeve at a position adjacent an opening end of said sleeve and in alignment with said strip sewn to the underside of said collar, and said first half of said lower side of said fabric is sewn to the outer side of said sleeve so that said bight is facing down, and said tab is opened by pulling downward on said male hooks of said second half of said fabric thereby disengaging said female loops of said first half of said fabric, and when said sleeve is retracted to said scapula position said male hooks can be releasably engaged with said strip sewn to the underside of said collar; and a braided twill tape loop of predetermined size, wherein said twill tape loop is sewn at each end to the inner side of said sleeve at a position horizontal and proximal to a midpoint measurement of the distance between said seam adjoining said collar to said neck opening and the open end of said sleeve, and when said sleeve is retracted to said clavicle position said tab is opened and passed through said twill tape loop gathering excess sleeve fabric and then releasably engaged to said strip sewn to the underside of said collar.

* * * * *